US011725659B2

(12) United States Patent
Decorde et al.

(10) Patent No.: US 11,725,659 B2
(45) Date of Patent: Aug. 15, 2023

(54) DRY-TYPE PRIMARY VACUUM PUMP AND METHOD FOR CONTROLLING THE INJECTION OF A PURGING GAS

(71) Applicant: PFEIFFER VACUUM, Annecy (FR)

(72) Inventors: Paul Decorde, Annecy (FR); Yannick Grenier, Doussard (FR)

(73) Assignee: PFEIFFER VACUUM, Annecy (FR)

( * ) Notice: Subject to any disclaimer, the term of this patent is extended or adjusted under 35 U.S.C. 154(b) by 85 days.

(21) Appl. No.: 17/619,394

(22) PCT Filed: May 15, 2020

(86) PCT No.: PCT/EP2020/063590

§ 371 (c)(1),
(2) Date: Dec. 15, 2021

(87) PCT Pub. No.: WO2020/254043

PCT Pub. Date: Dec. 24, 2020

(65) Prior Publication Data

US 2022/0372979 A1 Nov. 24, 2022

(30) Foreign Application Priority Data

Jun. 18, 2019 (FR) ..... 19 06546

(51) Int. Cl.
*F04C 23/00* (2006.01)
*F04C 18/16* (2006.01)
*F04C 25/02* (2006.01)

(52) U.S. Cl.
CPC ..... *F04C 23/001* (2013.01); *F04C 18/16* (2013.01); *F04C 25/02* (2013.01)

(58) Field of Classification Search
CPC ..... F04C 18/123; F04C 18/126; F04C 18/16; F04C 23/001; F04C 23/008; F04C 2/16;
(Continued)

(56) References Cited

U.S. PATENT DOCUMENTS 8,105,051 B2 * 1/2012 Kusay ..... F04C 28/28 417/282
10,808,730 B2 * 10/2020 Müller ..... F04C 28/02
(Continued)

FOREIGN PATENT DOCUMENTS

GB 2500610 A 10/2013
WO WO 2014/012896 A2 1/2014

OTHER PUBLICATIONS

International Search Report dated Jun. 25, 2020 in PCT/EP2020/063590 filed May 15, 2020, 2 pages.

*Primary Examiner* — Audrey B. Walter
*Assistant Examiner* — Dapinder Singh
(74) *Attorney, Agent, or Firm* — Oblon, McClelland, Maier & Neustadt, L.L.P.

(57) ABSTRACT

A dry-type primary vacuum pump includes an injection device to distribute a purging gas in the pumping stages. The injection device includes: a first pressure sensor arranged on a common portion of the distributor, a second pressure sensor arranged on each branch of the distributor, and a control unit to generate a pulse width modulation command signal for the control of the regulation valves independently of one another as a function of the pressure measurement differences between the first pressure sensor and the second pressure sensors.

12 Claims, 3 Drawing Sheets

(58) Field of Classification Search
CPC ..... F04C 25/02; F04C 29/00; F04C 29/02; F04C 29/12; F04C 29/0007; F04C 29/0014; F04C 2200/12; F04C 2240/81; F04C 2270/185; F04C 2270/585; F04C 2280/02; F01C 1/12
See application file for complete search history.

(56) References Cited

U.S. PATENT DOCUMENTS

| | | | | |
|---|---|---|---|---|
| 2008/0202116 | A1 | 8/2008 | Benstead et al. | |
| 2014/0102565 | A1 | 4/2014 | Jackson et al. | |
| 2014/0205482 | A1* | 7/2014 | Crochet ..... | F04C 25/02 418/5 |
| 2015/0170938 | A1 | 6/2015 | Seigeot | |
| 2020/0102960 | A1* | 4/2020 | Brandolin ..... | F04C 29/0092 |

* cited by examiner

1
M
F1
4
F2
12
18
2e
17e
16e
13e
11e
F2
15
2d
17d
13d
11d
F2
16d
14
2c
17c
16c
F2
13c
11c
2b
F2
16b
13b
17b
11b
2a
F1
3
F2
16a
13a
17a
11a
10
9
5

DRY-TYPE PRIMARY VACUUM PUMP AND METHOD FOR CONTROLLING THE INJECTION OF A PURGING GAS

The present invention relates to a dry-type primary vacuum pump such as of "Roots" or "Claw" or screw type. The present invention relates also to a method for controlling the injection of a purging gas in such a vacuum pump.

The dry-type primary vacuum pumps comprise several pumping stages in series in which a gas to be pumped circulates between a suction and a discharge. Known primary vacuum pumps that can be distinguished include those with rotary lobes also called "Roots" vacuum pumps or those with a beak, also referred to as "Claw" vacuum pumps or even screw vacuum pumps. These vacuum pumps are said to be "dry" because, in operation, the rotors rotate inside a stator with no mechanical contact between them or with the stator, which makes it possible not to use oil in the pumping stages.

Some primary vacuum pumps are employed in processes using gases whose condensation or powder solidification is to be avoided. Such is the case for example in certain processes for manufacturing semiconductors, photovoltaic screens, flat screens or LED screens. A significant accumulation of these solid by-products can affect the operation of the vacuum pump, notably by hampering the rotation of the rotors, even by totally preventing it in the worst cases.

To avoid that, provision is made to inject a purging gas into the vacuum pump. The purging gas dilutes the condensable gases and assists in driving the gaseous solid or simply solid by-products to the pump discharge. This purging gas is injected into the different pumping stages via a distributor. The flow rate injected at the input of the distributor is generally set manually and measured by a flowmeter.

One drawback is that the gas flow rate injected into the pumping stages can depend on the pressure of the supply network and can therefore vary with the fluctuations that can occur thereon. Another drawback is the interdependency between the purging gas flow rates injected into the different pumping stages. It is in fact not possible for example to reduce the purging gas flow rate in one pumping stage and increase it simultaneously in another. Also, the manual setting of the flow rate does not make it possible to prevent possible mishandling.

One known solution consists in using a device in which the input flow rate of the purging gas is controlled by means of a proportional valve regulated as a function of a measurement from a pressure or flow rate sensor. This control makes it possible to dispense with possible human errors or any fluctuations on the pressure of the purging gas supply network. However, the proportional valves and the flow rate controllers are expensive and the proportional valves are not always reliable. Furthermore, it is not possible with this device to control the purging gas flow rates injected into the pumping stages independently of one another.

One aim of the present invention is to at least partially resolve an abovementioned drawback of the state of the art.

To this end, the subject matter of the invention is a dry-type primary vacuum pump comprising:

- at least two pumping stages mounted in series between a suction and a discharge,
- two rotor shafts extending in the pumping stages, the rotors being configured to rotate synchronously in reverse directions to drive a gas to be pumped between the suction and the discharge,

- an injection device configured to distribute a purging gas in the pumping stages, comprising:
- a distributor comprising:
- a common portion intended to be linked to a purging gas source, and
- at least two branches connected on one side to the common portion and on the other side to a respective pumping stage, and
- a regulation valve that can be controlled to be on or off, arranged on each branch of the distributor, characterized in that the injection device also comprises:
- a first pressure sensor arranged on the common portion of the distributor,
- a second pressure sensor arranged on each branch of the distributor, and
- a control unit configured to generate a pulse width modulation command signal for the control of the regulation valves independently of one another as a function of the pressure measurement differences between the first pressure sensor and the second pressure sensors, in order to control the purging gas flow rate injected into the pumping stages according to predetermined setpoints associated with each pumping stage as a function of the percentage opening of the regulation valves over a predetermined period.

The pressure measurement difference between the first and a second sensor makes it possible to estimate the purging gas flow rate without using a flowmeter. The purging gas flow rates can thus be controlled automatically by taking account of the input pressure of the distributor measured by the first pressure sensor. Outside interventions, whether deliberate or not, on the input pressure thus disturb the purging gas flow rate injected into the stages of the vacuum pump little or not at all.

The independent control of the purging gas flow rate in each of the pumping stages can make it possible to adapt the flow rates for example as a function of the gases to be pumped or to implement specific purging profiles.

Another advantage of the injection device is that the modification of the pulse width modulation command signal of a regulation valve to control the purging gas flow rate to a predefined setpoint value has little or no impact on the controlled purging gas flow rate in the other pumping stages.

The vacuum pump can also comprise one or more of the features described hereinbelow, taken alone or in combination.

The period of the pulse width modulation command signal is, for example, greater than 800 ms.

The regulation valves can be configured to change state in less than 15 ms, such as less than 10 ms. This frequency makes it possible to ensure a substantially linear relationship between the duty cycle and the purging gas flow rate passing through the regulation valve. A linear relationship simplifies the calculation of the duty cycle of the PWM command signal since it is proportional to the purging gas flow rate.

The common branch can comprise a common volume to equalize the pressure at the input of the regulation valves. The common volume forms a gas reservoir that makes it possible to "smooth" the pressure each time a valve is opened/closed to equalize the pressure at the input of the regulation valves and thus make it possible to use only a single first pressure sensor and make the measurement reliable.

The injection device can comprise an injection member arranged on each branch of the distributor, having a respective conductance configured to limit the purging gas flow rate to a maximum value.

Also a subject matter of the invention is a method for controlling the injection of a purging gas in a dry-type primary vacuum pump as described previously, characterized in that a pulse width modulation command signal is generated for the control of the regulation valves independently of one another as a function of the pressure measurement differences between the first pressure sensor and the second pressure sensors, in order to control the purging gas flow rate injected into the pumping stages according to predetermined setpoints associated with each pumping stage as a function of the percentage opening of the regulation valves over a predetermined period.

The control method can comprise one or more of the features described hereinbelow, taken alone or in combination.

At least two duty cycles of the pulse width modulation command signals of two regulation valves can be in phase opposition.

Two regulation valves having pulse width modulation command signals in phase opposition can be arranged on the branches connected to the first two pumping stages, the first pumping stage communicating with the suction.

According to an exemplary embodiment, the pressure difference between two branches of the distributor connected to two successive pumping stages is measured to identify a malfunction.

For example:

- the predetermined purging gas flow rate setpoint associated with the pumping stages for which the pressure difference is below a predetermined threshold is increased, and/or
- the predetermined purging gas flow rate setpoint associated with the pumping stages for which the pressure difference is above a predetermined threshold is lowered.

Other advantages and features will become apparent on reading the description of the invention, and the attached drawings in which.

Figure 3A:
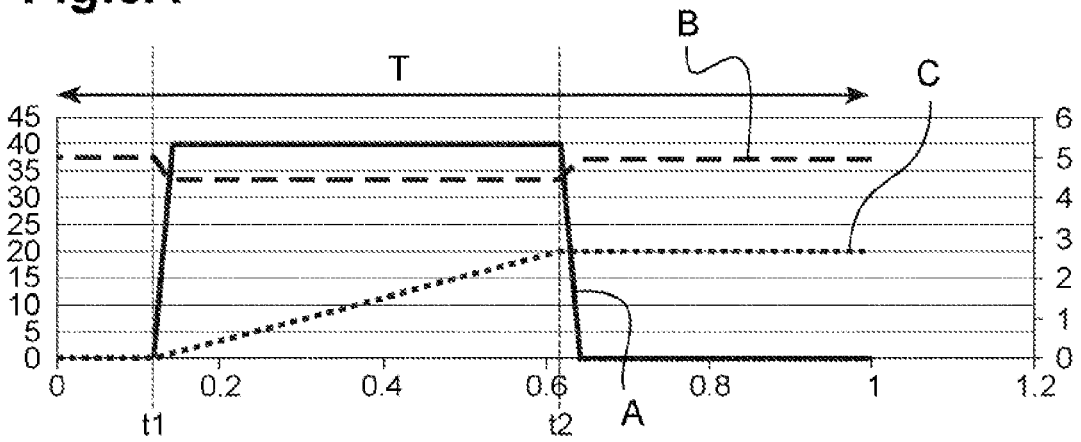

FIG. 3A is a graph showing the flow injected into a pumping stage (curve A), the input pressure of a distributor of the injection device (curve B) and an integral of the flow injected over a predetermined period (curve C) as a function of time (on the x axis) for a first example of control of a regulation valve associated with the pumping stage, the flow (in slm) being marked on the left hand y axis and the pressure (in bar) on the right hand y axis.

Figure 3B:
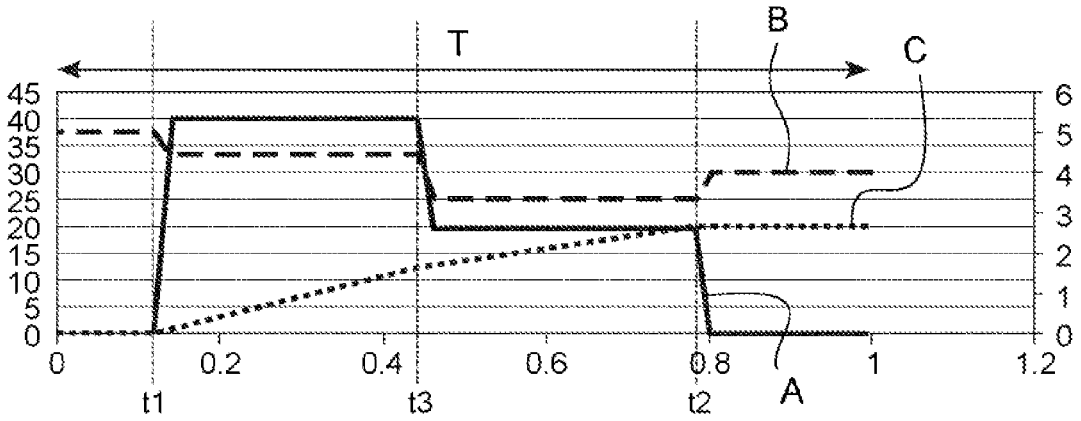

FIG. 3B shows a graph similar to that of FIG. 3A for a second example.

Figure 4:
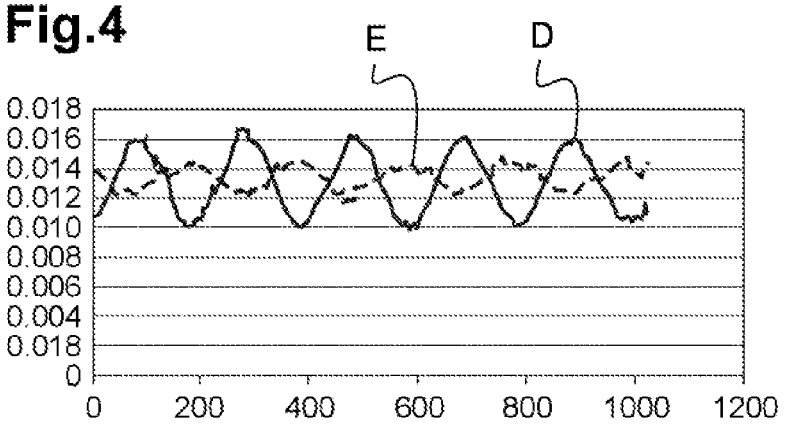

FIG. 4 is a graph showing the pressure at the suction of the vacuum pump (in mbar) as a function of time (in ms) for the PWM command signals of the first two pumping stages in phase (curve D) and in phase opposition (curve E).

In these figures, the elements that are identical bear the same reference numbers. The drawings are simplified to make them easier to understand.

The following embodiments are examples. Although the description refers to one or more embodiments, this does not necessarily mean that each reference relates to the same embodiment, or that the features apply only to a single embodiment. Simple features of different embodiments can also be combined or interchanged to provide other embodiments.

A volumetric vacuum pump which sucks, transfers, then discharges a gas to be pumped is defined as primary vacuum pump. In conventional use, a primary vacuum pump is configured to be able to discharge a gas to be pumped at ambient pressure.

Figure 1:
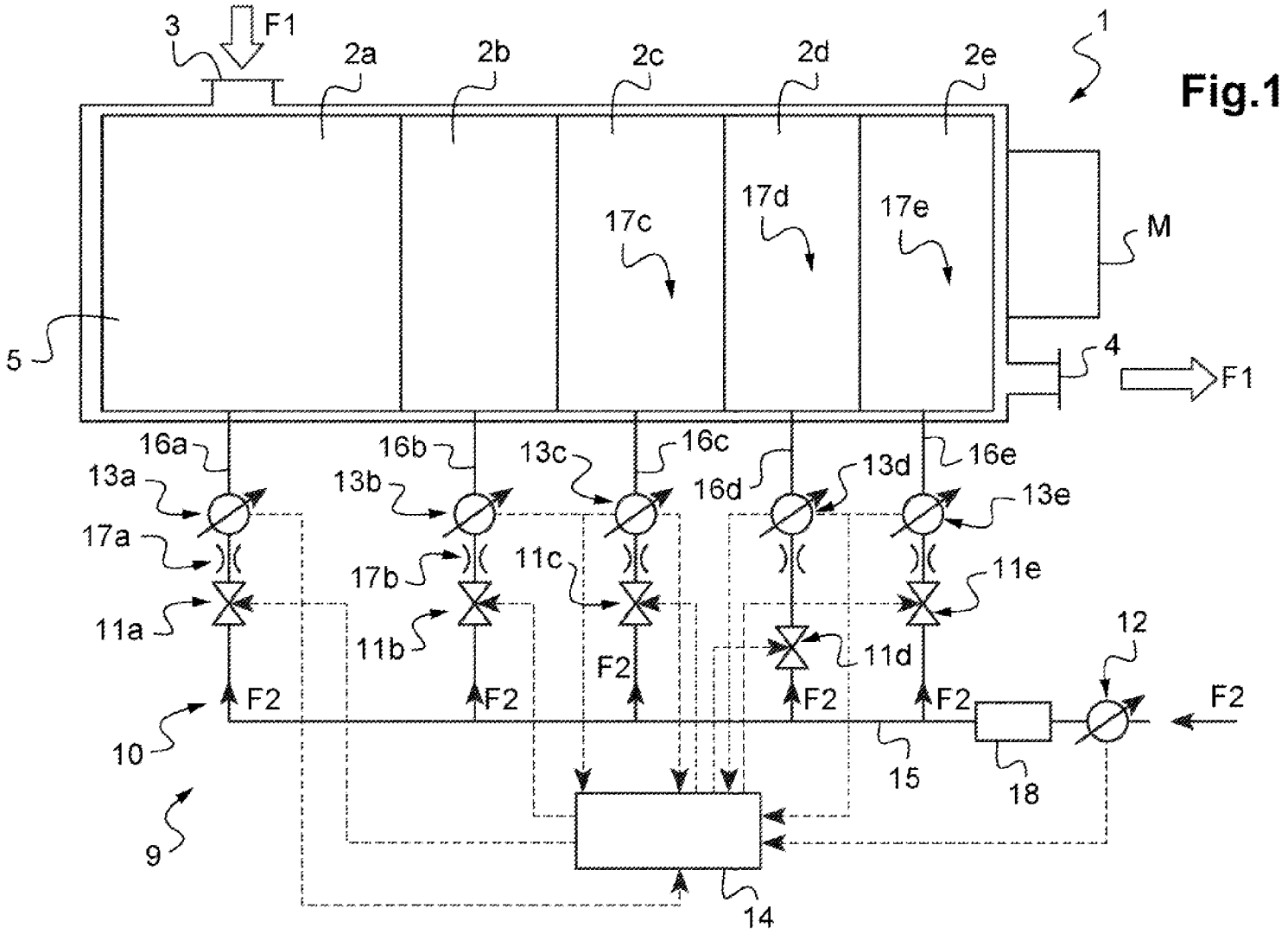
FIG. 1 shows a schematic view of an exemplary embodiment of a dry-type primary vacuum pump.

FIG. 1 represents an exemplary embodiment of a dry-type primary vacuum pump 1.

The vacuum pump 1 comprises a stator (or pump body) forming at least two pumping stages 2*a*-2*e* mounted in series between a suction 3 and a discharge 4 and in which a gas to be pumped can circulate (the direction of circulation of the pumped gases is illustrated by the arrows F1 in FIG. 1). The pumping stage 2*a* communicating with the suction 3 is the lowest-pressure stage, also called first pumping stage, and the pumping stage 2*e* communicating with the discharge 4 is the highest-pressure stage, also called last pumping stage. The vacuum pump 1 also comprises two rotor shafts 5 extending in the pumping stages 2*a*-2*e*.

In the illustrative example, the vacuum pump 1 comprises five pumping stages 2*a*, 2*b*, 2*c*, 2*d*, 2*e*. Each pumping stage 2*a*-2*e* is formed by a compression chamber receiving the rotors 5, the chambers comprising a respective input and output. The successive pumping stages 2*a*-2*e* are connected in series one after the other by respective inter-stage channels connecting the output of the preceding pumping stage to the input of the next stage.

The rotors 5 have, for example, lobes of identical profiles, for example of "Roots" type or of "Claw", or are of screw type or based on another similar volumetric vacuum pump principle.

The rotors 5 are configured to rotate synchronously in reverse directions in the pumping stages 2*a*-2*e*. During rotation, the gas sucked from the input is imprisoned in the volume created by the rotors 5 and the stator of the pumping stage 2*a*-2*e*, then is driven by the rotors 5 to the next stage.

The rotor shafts 5 are driven in rotation by a motor M of the vacuum pump 1 situated for example at one end.

The vacuum pump 1 also comprises an injection device 9 configured to distribute a purging gas, such as an inert gas, such as air, argon or nitrogen, in the pumping stages 2*a*-2*e*.

The injection device 9 comprises a distributor 10, regulation valves 11*a*-11*e*, a first pressure sensor 12, second pressure sensors 13*a*-13*e* and a control unit 14 to control the regulation valves 11*a*-11*e*.

The distributor 10 comprises a common portion 15 whose input is intended to be linked to a purging gas source, for example via an isolation valve, and at least two branches 16*a*-16*e* connected on one side to the common portion 15 and on the other side to a respective pumping stage 2*a*-2*e*.

The branches 16*a*, 16*e* connected to the first and last pumping stages 2*a*, 2*e* are for example configured to emerge at the main bearings of the vacuum pump 1, notably to protect the rolling bearings and the sealing devices situated at the two ends of the vacuum pump 1. The branches 16*b*, 16*c*, 16*d* connected to the intermediate pumping stages 2*b*, 2*c*, 2*d* are for example configured to emerge at the respective outputs of the stages.

The direction of circulation of the purging gas is illustrated by the arrows F2 in FIG. 1.

The injection device 9 can comprise an injection member 17*a*-17*e*, such as a gauged orifice (also called spray nozzle) or an injection nozzle, arranged on each branch 16*a*-16*e* of the distributor 10 and having a respective conductance configured to limit the purging gas flow rate to a maximum value. They are for example externalized from the pump body of the vacuum pump 1. The injection members 17*a*-17*e* are for example respectively interposed between a regulation valve 11*a*-11*e* and a second pressure sensor 13*a*-13*e*.

The regulation valves 11*a*-11*e* are arranged on each branch 16*a*-16*e* of the distributor 10. The regulation valves 11*a*-11*e* can be controlled to be on or off: they are either open (state=1), or closed (state=0) and can switch at high speed, that is to say change state over very short times, for example less than 15 ms, such as less than 10 ms. They are for example solenoid valves, such as electromagnetic or piezoelectric valves. They can therefore be controlled to open and close by a slotted command signal. The control of the regulation valves 11*a*-11*e* by a slotted command signal makes it possible to obtain an injection of purging gas into the pumping stages 2*a*-2*e* by pulsing. Injection by pulsing notably facilitates the driving of the powders to the discharge 4 of the pump. The regulation valves 11*a*-11*e* that can be controlled to be on or off offer the advantage of being simple, reliable, of little bulk and inexpensive.

The first pressure sensor 12 is arranged on the common portion 15 of the distributor 10 and the second pressure sensors 13*a*-13*e* are arranged on a respective branch 16*a*-16*e* of the distributor 10. The pressure sensors 12, 13*a*-13*e* are for example piezoelectric pressure sensors.

The control unit 14, such as an electronic circuit board, comprises one or more controllers or microcontrollers or processors and a memory, to execute the series of program instructions implementing a method for controlling the injection of a purging gas in the vacuum pump 1.

More specifically, the control unit 14 is configured to generate a pulse width modulation (PWM) command signal for the control of the opening and the closing of the regulation valves 11*a*-11*e* independently of one another as a function of the pressure measurement differences between the first pressure sensor 12 and the second pressure sensors 13*a*-13*e*.

The pressure measurement difference between the first sensor 12 and a second sensor 13*a*-13*e* makes it possible to estimate the purging gas flow rate without using a flowmeter. Using pressure sensors rather than flowmeters to measure a flow is more advantageous on the one hand because the pressure sensor is of the order of four to five times less expensive than a flowmeter, and on the other hand because it is less bulky. Incorporating second pressure sensors 13*a*-13*e* on each branch of the distributor 10 can then be considered both from the economic point of view and in terms of bulk. The pressure sensors are also easier to implement than the flowmeters because their dimensions are standardized for different ranges. It is therefore possible to change sensor without also adapting the distributor 10.

According to an exemplary embodiment, provision is also made for the common branch 15 of the distributor 10 to comprise a common volume 18. The common volume 18 has, for example, a volume of between 100 ml and 400 ml. It forms a gas reservoir that makes it possible to absorb the small pressure fluctuations each time a valve opens/closes, to equalize the pressure at the input of the regulation valves 11*a*-11*e* to thus make it possible to use only a single first pressure sensor 12 and make the measurement reliable.

The PWM command signal makes it possible to control the purging gas flow rate injected into the pumping stages 2*a*-2*e* according to predetermined setpoints associated with each pumping stage 2*a*-2*e* as a function of the percentage opening of the regulation valves 11*a*-11*e* over a predetermined period T.

More specifically, the PWM command signal is a slotted signal that can take 0 or 1 values. The signal is periodic of period T. The ratio of the open time of a regulation valve 11*a*-11*e* over the period T, or duty cycle, expressed as a percentage, makes it possible to control the average flow rate passing through the regulation valve 11*a*-11*e* for it to correspond to the desired setpoint.

When the regulation valve is closed over the period T, the duty cycle is nil. When the valve is open over the period T, the duty cycle is 100% and the purging gas flow rate passing through the valve is maximal. The maximum flow rate can be adjusted by dimensioning the restriction of the regulation valve 11*a*-11*e* or of the injection member 17*a*-17*e* at the output of the regulation valve 11*a*-11*e*.

To control the purging gas flow rate injected into the pumping stages 2*a*-2*e* according to predetermined setpoints associated with each pumping stage 2*a*-2*e*, the duty cycle of the PWM command signal is lowered when the purging gas flow rate estimated by the pressure difference is above the setpoint and it is increased if the flow rate is below.

The period T of the PWM command signal is for example greater than 800 ms, such as greater than 1000 ms. This frequency makes it possible to ensure a substantially linear relationship between the duty cycle and the purging gas flow rate passing through the regulation valve. A linear relationship simplifies the calculation of the duty cycle of the PWM command signal since it is proportional to the purging gas flow rate.

Figure 2A:
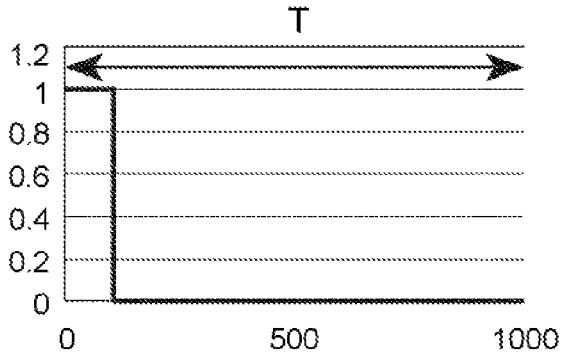
FIG. 2A is a graph showing an example of the state of a regulation valve of an injection device of the vacuum pump of FIG. 1 as a function of time (in ms) for a first example of duty cycle.
Figure 2B:
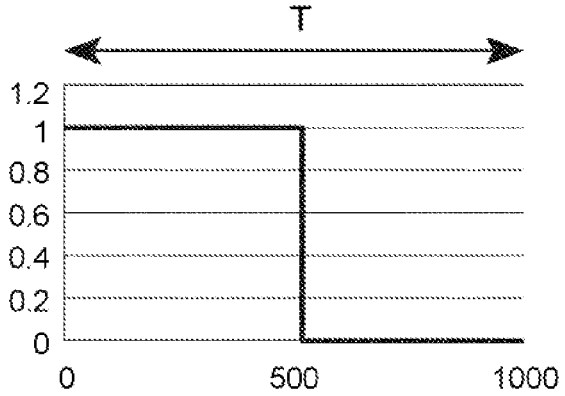
FIG. 2B shows the graph of FIG. 2A for a second example of duty cycle.
Figure 2C:
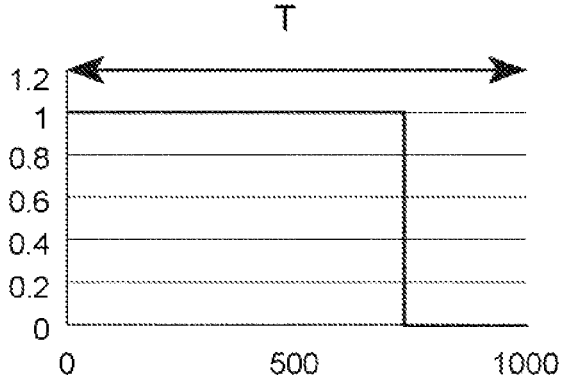
FIG. 2C shows the graph of FIG. 2A for a third example of duty cycle.

The graphs of FIGS. 2A, 2B, 2C thus show three examples of pulse width modulation command signals over a period T of 1 second.

FIG. 2A shows a first PWM command signal for which the regulation valve is open (state=1) 10% of the time over the period T, FIG. 2B shows a second PWM command signal for which the regulation valve is open (state=1) 50% of the time over the period T and FIG. 2C shows a third PWM command signal for which the regulation valve is open (state=1) 75% of the time over the period T.

For example, for a maximum nitrogen flow of 40 slm, a PWM command signal of 10% duty cycle (FIG. 2A) makes it possible to control a flow rate at 4 slm, a PWM command signal of 50% duty cycle (FIG. 2B) makes it possible to control a flow rate at 20 slm and a PWM command signal of 75% duty cycle (FIG. 2C) makes it possible to control a flow rate at 30 slm.

The purging gas flow rates can thus be controlled automatically by taking account of the input pressure of the distributor 10 measured by the first pressure sensor 12. Outside interventions, deliberate or not, on the input pressure thus have little or no disruptive impact on the purging gas flow rate injected into the stages of the vacuum pump 1. On the other hand, an unusual regulation of the regulation valves 11*a*-11*e*, outside of predefined ranges, can make it possible to diagnose a malfunction of the vacuum pump 1 or a purging gas supply problem. This diagnosis can make it possible to put in place automatic actions for protecting or correcting the vacuum pump 1. Also, the independent control of the purging gas flow rate in each of the pumping stages 2*a*-2*e* can make it possible to adapt the flow rates for example as a function of the gases to be pumped or, as will be seen later, to implement specific purging profiles.

It is for example possible to modify the flow rates (within the limit of the maximum values permitted by the injection members 17*a*-17*e*), for example to increase them in the event of significant polluting gas flows or to reduce them in standby phases.

For example, the control unit 14 is configured to receive information from equipment using the vacuum pump 1, via a communication means such as a serial link or a dry contact.

This information can be purging flow setpoints associated with each pumping stage 2*a*-2*e*. It is thus possible to match the purging flow setpoints to the recipes of gas flows injected into the processing chamber of the equipment.

According to another example, this information makes it possible to determine whether the chamber of the equipment is in the process of treating a substrate or in standby phase. It is then for example possible to select a recipe of purging flow setpoints suited to the situation in the processing chamber from among the prestored recipes.

According to another example, the purging flow setpoints associated with each pumping stage 2*a*-2*e* are determined without information from the equipment, but only as a function of signals from sensors of the vacuum pump 1, such as, for example, as a function of the power consumed by the vacuum pump 1, the latter being able to make it possible to indicate a processing or standby phase in the chamber.

Another advantage of the injection device 9 is that the modification of the

PWM command signal of a regulation valve to control the purging gas flow rate to a predefined setpoint value has little or no impact on the controlled purging gas flow rate in the other pumping stages.

This will be able to be better understood with reference to the example described hereinbelow and represented in the graphs of FIGS. 3A and 3B.

FIG. 3A shows that, to obtain for example an average flow of 20 slm over 1 second (curve C), the PWM command signal has a duty cycle of 50%, the injected flow being 40 slm over 0.5 seconds between t1 and t2 and nil over 0.5 seconds between 0 and t1 and between t2 and T (curve A). The opening of the regulation valve at the time t1 allowing for the injection of the flow of 40 slm provokes a slight lowering of the input pressure of the distributor 10 (curve B). This pressure variation, here less than a bar, is relatively low and does not influence the estimated flow rate which passes through the regulation valve such that the duty cycle of the PWM command signal remains equal to 50%.

On the other hand, in the example of FIG. 3B, the opening of a second regulation valve on another branch of the distributor 10 at the time t3 generates a second lowering of the input pressure of the distributor 10. The aggregate pressure drop provoked by the successive openings of the regulation valves is then more than 1 bar (curve B), which significantly lowers the flow (curve A) and leads to an adaptation of the duty cycle of the PWM command signal. The duty cycle goes to 65%, thus leaving the regulation valve open for longer than for the preceding example over the period T, thus compensating for the pressure drop to reach the flow rate setpoint of 20 slm at the end of the period T (curve C).

It is found that the automatic control of the individual flow rates as a function of the pressure measurement differences makes it possible to rapidly make up for and correct the deviations between the flow rate and the setpoint.

FIG. 4 is a graph showing an example of a particular purging profile.

In this example, at least two duty cycles of pulse width modulation command signals of two regulation valves are in phase opposition. They are for example the two regulation valves 11*a*, 11*b* arranged on the branches 16*a*, 16*b* of the distributor 10 connected to the first two pumping stages 2*a*, 2*b* of the vacuum pump 1.

It can be seen that the phase opposition control (curve E) makes it possible to reduce (here by two) the possible impact of the injection of a purging gas flow on the limit vacuum pressure at the suction 3 of the vacuum pump 1 compared to the in-phase control (curve D), the limit vacuum pressure being the minimum pressure obtained in the absence of gas flow to be pumped. It is also found that the impact on the suction pressure is limited because it is lower than 0.006 mbar with in-phase control on the first two pumping stages 2*a*, 2*b*.

It is also worth noting that the pulsed injection has little or no effect on the dynamic behaviour of the vacuum pump (in the presence of gas flow to be pumped). Furthermore, this injection has little or no impact on the suction pressure when it is performed in the last pumping stages 2*c*-2*e*.

The injection device 9 can also be an aid to diagnosing faults from the vacuum pump 1.

Indeed, the second pressure sensors 13*a*-13*e* arranged on a respective branch of the distributor 10 make it possible to obtain an image of the pressure in each of the pumping stages 2*a*-2*e* of the vacuum pump 1. Consequently, they can be used to identify a malfunction, for example by measuring the pressure difference between two branches 16*a*-16*e* of the distributor 10 connected to two successive pumping stages 2*a*-2*e*.

A lowering of the pressure difference between two branches 16*a*-16*e* of the distributor 10 connected to two successive pumping stages 2*a*-2*e* can make it possible to locate clogging, that is to say a zone of the vacuum pump in which by-products might have agglomerated. For example, a pressure difference below a predetermined threshold between the second pressure sensor 13*a* arranged on the branch 16*a* connected to the first pumping stage 2*a* and the second pressure sensor 13*b* arranged on the branch 16*b* connected to the second pumping stage 2*b* may reveal a build-up of powder located between these first two pumping stages 2*a*, 2*b*.

A curative purging profile can be put in place. For example, the predetermined purging gas flow rate setpoint, associated with the pumping stages in which a zone to be treated has been located, and possibly the pumping stages situated upstream, is increased to trigger a more severe injection at these points to discharge the accumulated solid by-products. The setpoint increase is done notably within the limit of admissible thresholds not affecting the pumping performance levels.

According to another example, an increase in the pressure difference between two branches 16*a*-16*e* of the distributor 10 connected to two successive pumping stages 2*a*-2*e* may indicate a loss of performance levels of the vacuum pump 1, for example caused by an increase in the operating play between the rotors 5 and the stator.

It is then possible to lower the predetermined purging gas flow rate setpoint associated with the identified pumping stages and possibly with the pumping stages situated upstream, to compensate for the loss of pumping efficiency. The lowering of the setpoint is done notably within the limit of admissible thresholds, making it possible to guarantee a minimal purging, notably at the main bearings of the vacuum pump 1.

These characteristics of the state of operation of the vacuum pump 1 can be realized in operation or in standby phase (periods of non-use).

It is understood that such an injection device 9 is simple, reliable, of little bulk and inexpensive because of the low cost of its components. It also offers new possibilities for diagnostic functionalities, curative actions, protection or improvement of the performance levels of the vacuum pump 1.

The invention claimed is:

1. A dry-type primary vacuum pump comprising:

at least two pumping stages mounted in series between a suction and a discharge, two rotor shafts extending in the pumping stages, the rotors being configured to rotate synchronously in reverse directions to drive a gas to be pumped between the suction and the discharge, and an injection device configured to distribute a purging gas in the pumping stages, comprising:

a distributor comprising:

a common portion configured to be linked to a purging gas source, and at least two branches connected on one side to the common portion and on the other side to a respective pumping stage, a regulation valve that can be controlled to be on or off, arranged on each branch of the distributor, a first pressure sensor arranged on the common portion of the distributor, a second pressure sensor arranged on each branch of the distributor, and a control unit configured to generate a pulse width modulation command signal for the control of the regulation valves independently of one another as a function of the pressure measurement differences between the first pressure sensor and the second pressure sensors, in order to control the purging gas flow rate injected into the pumping stages according to predetermined setpoints associated with each pumping stage as a function of the percentage opening of the regulation valves over a predetermined period.

2. The vacuum pump according to claim 1, wherein the period of the pulse width modulation command signal is greater than 800 ms.

3. The vacuum pump according to claim 1, wherein the regulation valves are configured to change state in less than 15 ms.

4. The vacuum pump according to claim 1, wherein the regulation valves are configured to change state in less than 10 ms.

5. The vacuum pump according to claim 1, wherein the common branch comprises a common volume to equalize the pressure at the input of the regulation valves.

6. The vacuum pump according to claim 1, wherein the injection device comprises an injection member arranged on each branch of the distributor, including a respective conductance configured to limit the flow rate of the purging gas to a maximum value.

7. A method for controlling an injection of a purging gas into the vacuum pump according to claim 1, the method comprising:

generating a pulse width modulation command signal for control of the regulation valves independently of one another as a function of the pressure measurement differences between the first pressure sensor and the second pressure sensors, in order to control the purging gas flow rate injected into the pumping stages according to the predetermined setpoints associated with each pumping stage as a function of the percentage opening of the regulation valves over the predetermined period.

8. The method according to claim 7, wherein at least two duty cycles of the pulse width modulation command signals of two regulation valves are in phase opposition.

9. The method according to claim 8, wherein two regulation valves including pulse width modulation command signals in phase opposition are arranged on the branches connected to the first two pumping stages, the first pumping stage communicating with the suction.

10. The method according to claim 7, wherein the pressure difference between two of the branches of the distributor connected to two successive pumping stages is measured to identify a malfunction.

11. The method according to claim 10, wherein the predetermined purging gas flow rate setpoint associated with the pumping stages for which the pressure difference is below a predetermined threshold is increased.

12. The method according to claim 10, wherein the predetermined purging gas flow rate setpoint associated with the pumping stages for which the pressure difference is above a predetermined threshold is lowered.

* * * * *